US006145489A

United States Patent [19]

Kazama et al.

[11] Patent Number: 6,145,489

[45] Date of Patent: Nov. 14, 2000

[54] TORQUE CONTROLLER FOR INTERNAL COMBUSTION ENGINE

[75] Inventors: Isamu Kazama; Hiroshi Iwano; Masayuki Yasuoka, all of Kanagawa-ken, Japan

[73] Assignee: Nissan Motor Co., Ltd., Yokohama, Japan

[21] Appl. No.: 09/211,039

[22] Filed: Dec. 15, 1998

[30] Foreign Application Priority Data

Dec. 15, 1997 [JP] Japan ..... 9-345144

[51] Int. Cl.[7] ..... F02B 17/00; F02D 41/14

[52] U.S. Cl. ..... 123/295; 123/399; 123/436; 123/486

[58] Field of Search ..... 123/295, 305, 123/399, 430, 478, 480, 486, 436

[56] References Cited

U.S. PATENT DOCUMENTS

| | | | |
|---|---|---|---|
| 5,813,386 | 9/1998 | Okada et al. | 123/339.14 |
| 5,832,895 | 11/1998 | Takahashi et al. | 123/350 |
| 5,931,138 | 8/1999 | Uchida | 123/436 |
| 6,006,717 | 12/1999 | Suzuki et al. | 123/295 |
| 6,006,724 | 12/1999 | Takahashi et al. | 123/399 X |
| 6,024,069 | 2/2000 | Yoshino | 123/295 |
| 6,026,779 | 2/2000 | Obata et al. | 123/295 |

FOREIGN PATENT DOCUMENTS

| | | |
|---|---|---|
| 59-37236 | 2/1984 | Japan . |
| 62-110536 | 5/1987 | Japan . |

OTHER PUBLICATIONS

Nissan Motor Co., Ltd.; "Nissan Direct–Injection Engine"; NeoDi Direct Injection; pp. 1–19.

*Primary Examiner*—Tony M. Argenbright
*Attorney, Agent, or Firm*—Foley & Lardner

[57] ABSTRACT

A torque controller for a direct-injection type internal combustion engine achieves the target engine torque accurately, without being affected by the combustion mode. The combustion efficiency is different depending on whether an engine combustion mode is in a homogeneous combustion mode or a stratified combustion mode. The torque controller calculates an eventual target intake air flow rate TTP2 based on the target intake air flow rate TTPO, the target air/fuel ratio tDML, and the combustion efficiency correction rate ITAF, which is calculated based on the combustion mode.

12 Claims, 11 Drawing Sheets

26
APS
33,34
Ne
A
APS
tTEO
Ne
tTEO
B
tTEO
TTP0
Ne
TTP0
TTP1
TTP2
E
TTP2
TTPS
Ne
TTPS
21
31
C
APS
tDML
Ne
tDML
D
ITAF
tDML
ITAF
tDML
ITAF
COMBUSTION MODE SIGNAL
FOR HOMOGENEOUS COMBUSTION
FOR STRATIFIED COMBUSTION
F
Tp = k• Qa/Ne
Tp
G
Ti = Tp x tDML + Ts
Ti
22
INJECTOR

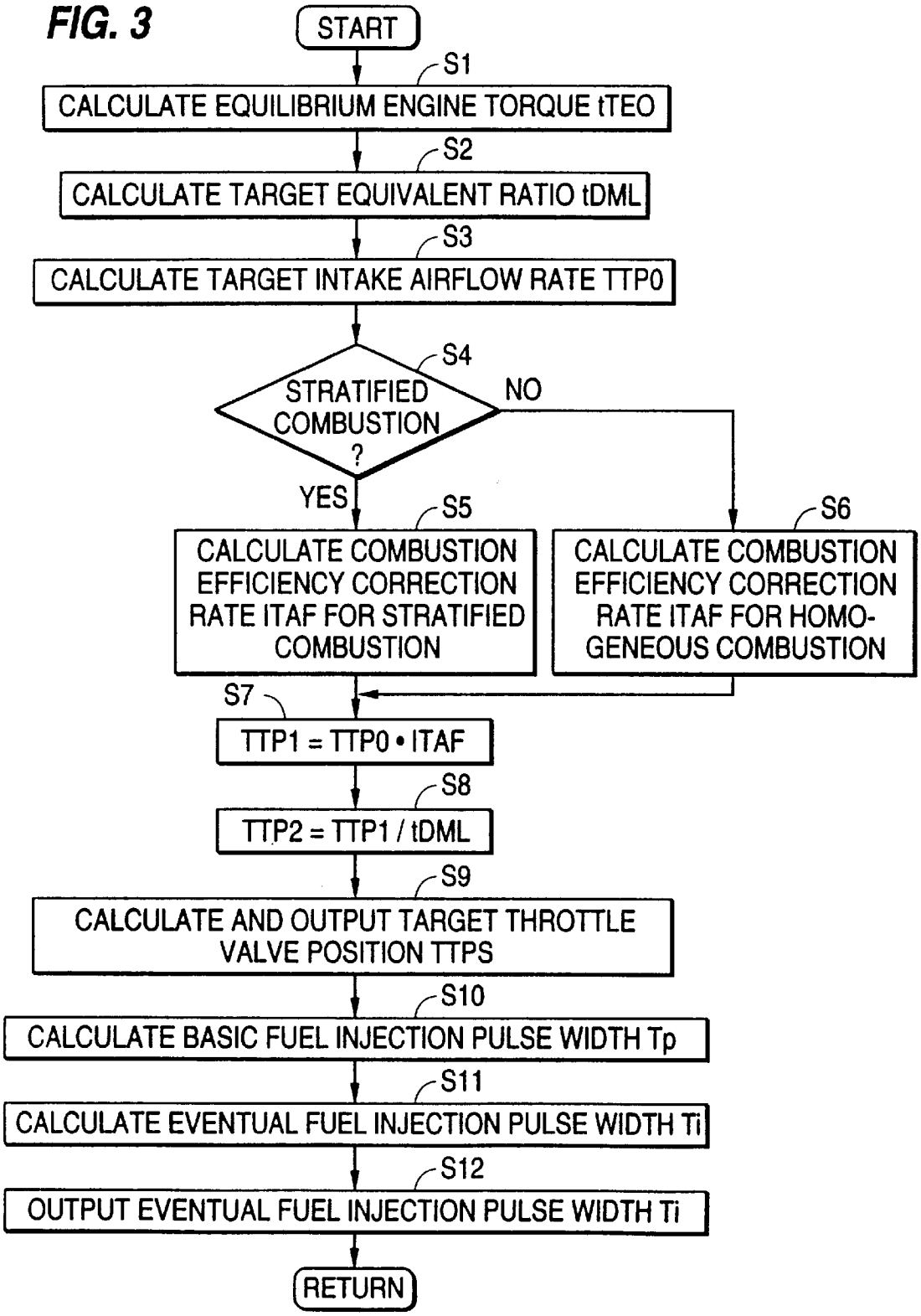
FIG. 3
START
S1
CALCULATE EQUILIBRIUM ENGINE TORQUE tTEO
S2
CALCULATE TARGET EQUIVALENT RATIO tDML
S3
CALCULATE TARGET INTAKE AIRFLOW RATE TTP0
S4
STRATIFIED COMBUSTION ?
NO
YES
S5
CALCULATE COMBUSTION EFFICIENCY CORRECTION RATE ITAF FOR STRATIFIED COMBUSTION
S6
CALCULATE COMBUSTION EFFICIENCY CORRECTION RATE ITAF FOR HOMO-GENEOUS COMBUSTION
S7
TTP1 = TTP0 • ITAF
S8
TTP2 = TTP1 / tDML
S9
CALCULATE AND OUTPUT TARGET THROTTLE VALVE POSITION TTPS
S10
CALCULATE BASIC FUEL INJECTION PULSE WIDTH Tp
S11
CALCULATE EVENTUAL FUEL INJECTION PULSE WIDTH Ti
S12
OUTPUT EVENTUAL FUEL INJECTION PULSE WIDTH Ti
RETURN A
APS
tTEO
Ne
B
tTEO
TTP0
Ne
TTP0
TTP2
E
TTP2
TTPS
Ne
TTPS
21
31
26
APS
33,34
Ne
C
APS
tDML
Ne
D
ITAF
tDML
ITAF
tDML
ITAF
COMBUSTION MODE SIGNAL
FOR STRATIFIED COMBUSTION
FOR HOMOGENEOUS COMBUSTION
F
Tp = k• Qa/Ne
Tp
G
Ti = Tp x tDML + Ts
Ti
22
INJECTOR 26
APS
33,34
Ne
A
APS
tTEO
Ne
tTEO
B'
TTC
TTP0
Ne
TTC
TTP0
TTP1
TTP2
E
TTP2
TTPS
Ne
TTPS
21
31
C
APS
tDML
Ne
tDML
H
Tpl
tDML
COMBUSTION MODE SIGNAL
D
ITAF
tDML
ITAF
tDML
ITAF
FOR STRATIFIED COMBUSTION
FOR HOMOGENEOUS COMBUSTION
Tp = k• Qa/Ne
F
Tp
Ti = Tp x tDML + Ts
G
Ti
22
INJECTOR 26
APS
33,34
Ne
A
APS
tTEO
Ne
tTEO
B
tTEO
TTP0
Ne
TTP0
TTP1
ITAF'
TTP2
E
TTP2
TTPS
Ne
TTPS
21
31
C
APS
tDML
Ne
tDML
D'
ITAF
tDML
ITAF
Tp = k• Qa/Ne
F
Tp
Ti = Tp x tDML + Ts
G
Ti
22
INJECTOR
COMBUSTION MODE SIGNAL
I
1
Gain
GAIN FOR STRATIFIED COMBUSTION

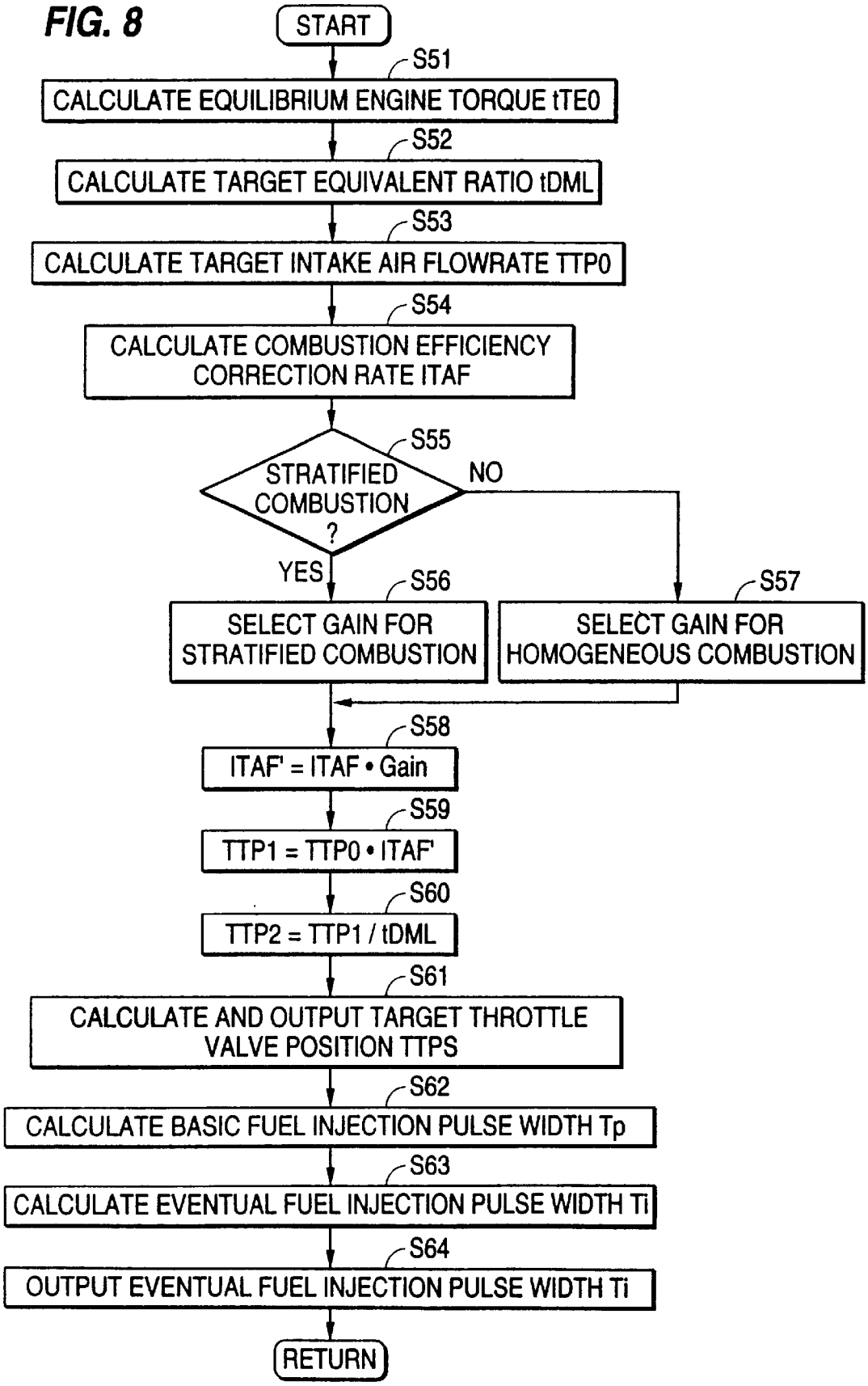
FIG. 8
START
S51
CALCULATE EQUILIBRIUM ENGINE TORQUE tTE0
S52
CALCULATE TARGET EQUIVALENT RATIO tDML
S53
CALCULATE TARGET INTAKE AIR FLOWRATE TTP0
S54
CALCULATE COMBUSTION EFFICIENCY CORRECTION RATE ITAF
S55
STRATIFIED COMBUSTION ?
NO
YES
S56
SELECT GAIN FOR STRATIFIED COMBUSTION
S57
SELECT GAIN FOR HOMOGENEOUS COMBUSTION
S58
ITAF' = ITAF • Gain
S59
TTP1 = TTP0 • ITAF'
S60
TTP2 = TTP1 / tDML
S61
CALCULATE AND OUTPUT TARGET THROTTLE VALVE POSITION TTPS
S62
CALCULATE BASIC FUEL INJECTION PULSE WIDTH Tp
S63
CALCULATE EVENTUAL FUEL INJECTION PULSE WIDTH Ti
S64
OUTPUT EVENTUAL FUEL INJECTION PULSE WIDTH Ti
RETURN

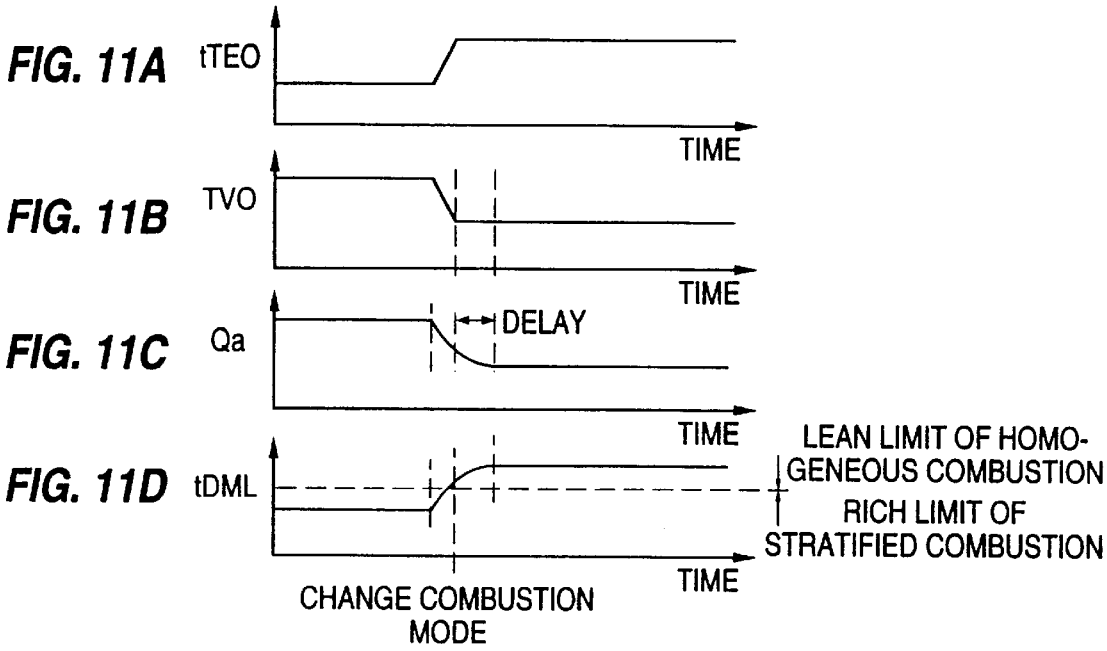
FIG. 12
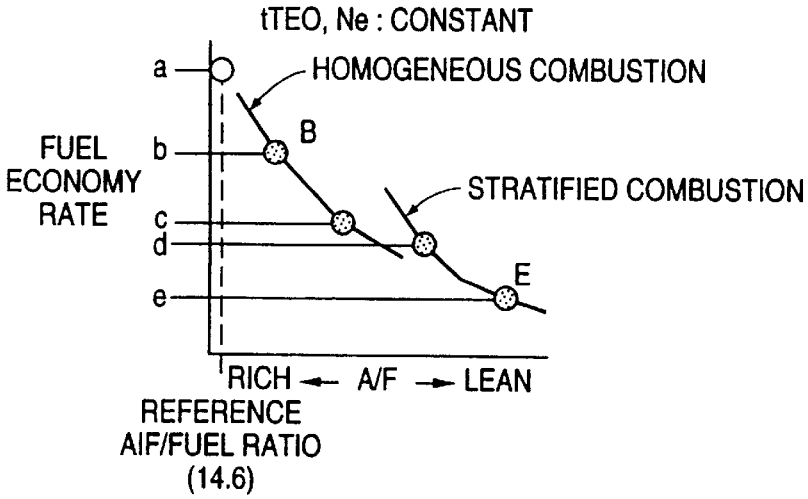

TORQUE CONTROLLER FOR INTERNAL COMBUSTION ENGINE

CROSS REFERENCE TO RELATED APPLICATION

The entire contents of Japanese application Tokugan Hei 9-345144, with a filing date of Dec. 12, 1997 in Japan, is hereby incorporated by reference.

BACKGROUND OF THE INVENTION

The invention is directed to a torque controller for an internal combustion engine by controlling intake air quantity based on a state of combustion.

As discussed in Japanese Patent Kokai No. 62-110536, in order to achieve a target engine torque, a target opening degree of an electronic controlled throttle valve is calculated from a lookup table, which defines the target throttle position as a function of target engine torque and engine rotation.

The conventional practice is made on an assumption that the air/fuel ratio is fixed at a predetermined value, for example, at the stoichiometric air/fuel ratio. Therefore, in this case, the lookup table which defines the target opening degree of the throttle valve has settings suitable for the stoichiometric air/fuel ratio. Thus, the conventional practice cannot be applied to the engine which changes the air/fuel ratio according to engine operating conditions.

In recent years, direct-injection gasoline engines have attracted special interest. In such a direct-injection gasoline engine, as discussed in Japanese Patent Kokai No. 59-37236, the combustion mode changes between a homogeneous combustion and a stratified combustion according to the engine operating conditions.

In the homogeneous combustion, fuel is injected during an intake stroke to diffuse the injected fuel so as to form a homogeneous mixture in the combustion chamber. On the other hand, in the stratified combustion, fuel is injected during a compression stroke to form a stratified fuel mixture around a spark plug.

BRIEF SUMMARY OF THE INVENTION

With such a direct-injection engine, a produced engine torque is different between the homogeneous combustion and the stratified combustion, even if the air/fuel ratio is the same.

For example, in the homogeneous combustion, when the air/fuel ratio is 25, the air/fuel ratio around the spark plug is also 25. On the other hand, in the stratified combustion, when the air/fuel ratio in the entire combustion chamber is 25, the air/fuel ratio around the spark plug is much less, for example 10, since the air/fuel ratio around the spark plug is very rich, fuel is concentrated around the spark plug. This results in the combustion efficiency in the stratified combustion being worse than in the homogeneous combustion. In short, the combustion efficiency is different according to the state of combustion.

Therefore, even though the target opening degree of the throttle valve is corrected based on the air/fuel ratio, the target engine torque cannot be achieved accurately. Also a torque difference occurs when the state of combustion changes, for example, when the combustion mode changes between the homogeneous combustion and the stratified combustion.

In view of these considerations, it is an object of the invention to provide a torque controller for an internal combustion engine which can achieve the target engine torque, without being affected by the state of combustion.

Another object of the invention is to provide a torque controller for a direct-injection type internal combustion engine which can achieve the target engine torque, without being affected by the combustion mode.

Another object of the invention is to provide a torque controller for an internal combustion engine which can achieve the target engine torque, without being affected by change of the combustion mode between the homogeneous combustion and the stratified combustion.

In order to achieve the above objects, the invention provides a torque controller which controls an intake air quantity of an internal combustion engine. A detector detects an engine operating condition including a state of combustion, a calculation section calculates a target intake air quantity and a target ratio of air and fuel based on the engine operating condition, and a correction section corrects the target intake air quantity based on the state of combustion and the target ratio of air and fuel.

Preferably, the invention may be applied to a direct-injection type internal combustion engine, which changes the combustion mode.

Also, the invention may be applied to an engine which operates in the homogeneous combustion mode mid in the stratified combustion mode, in which a detector detects an engine operating conditions including whether an engine combustion mode is in a homogeneous combustion mode or a stratified combustion mode, a target intake air quantity calculation section calculates a target intake air quantity based on the engine operating condition, a target ratio of air and fuel calculation section calculates a target ratio of air and fuel based on the engine operating condition, a combustion efficiency correction rate calculation section calculates a combustion efficiency correction rate based on the combustion mode and the target ratio of air and fuel, and a correction section corrects the target intake air quantity based on the combustion efficiency correction rate and the target ratio of air and fuel.

BRIEF DESCRIPTION OF THE DRAWINGS

FIG. 3 is a flow diagram used in a first embodiment.

FIG. 8 is a flow diagram used in a fourth embodiment.

FIGS. 11A–D shown operational diagram of an engine.

FIG. 12 is a diagram illustrating a fuel economy rate corresponds to an air/fuel ratio under a constant condition of an engine rotation and an engine torque.

DETAILED DESCRIPTION OF PREFERRED EMBODIMENTS

The invention will now be described by way of preferred embodiments in connection with the accompanying drawings.

Figure 1:
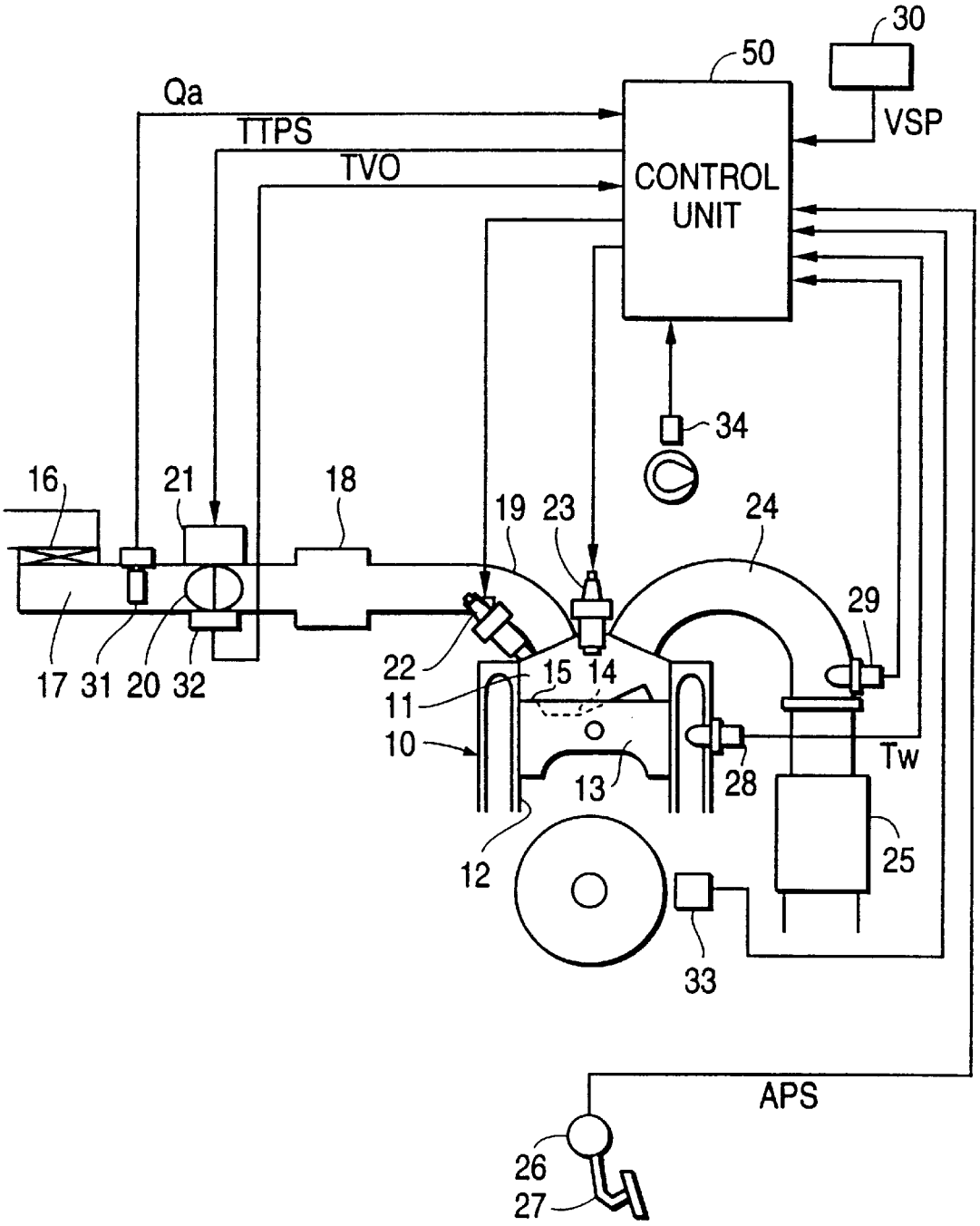
FIG. 1 is a system diagram of an engine embodying the invention.

FIG. 1 is a system diagram showing a direct-injection type gasoline internal combustion engine embodying the invention.

A multi-cylinder engine 10 for a vehicle includes a combustion chamber 11 and a cylinder 12. A piston 13, which reciprocates in the cylinder 12, has a shallow bowl 14 on the piston crown 15 in order to accomplish a stratified combustion and a homogeneous combustion. The stratified combustion and the homogeneous combustion are explained in detail later.

Intake air is introduced from an air cleaner 16 through an intake passage 17, an intake manifold 18, and an intake port 19 to the cylinder 12. Intake air quantity is controlled by a throttle valve 20, which is provided in the intake passage 17. The throttle valve 20 is actuated by an actuator 21, for example, a step motor operable in response to a drive signal outputted from a control unit 50.

An electro-magnetic fuel injector 22, which injects fuel directly into the combustion chamber 11, is disposed to provide fuel to each cylinder 12. The fuel injector 22 injects fuel when its solenoid receives a fuel injection pulse signal outputted from the control unit 50.

In the case where the fuel is injected during an intake stroke, in synchronism with engine rotation, fuel diffuses into the combustion chamber to form a homogeneous mixture. On the other hand, in the case where the fuel is injected during a compression stroke, in synchronism with engine rotation, a stratified mixture is formed around a spark plug 23.

The spark plug 23, for igniting the mixture in the combustion chamber 11, is mounted at the center of the cylinder 12. A spark timing is controlled by the control unit 50 based on the engine operating conditions.

Figure 10:
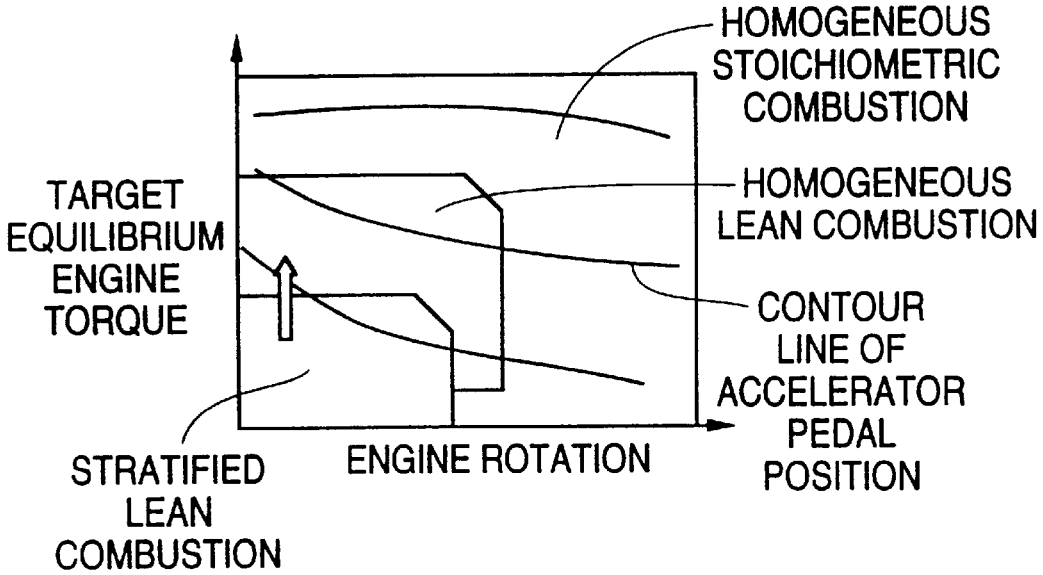
FIG. 10 is a diagram illustrating a combustion mode.

As shown in FIG. 10, the combustion modes include the homogeneous stoichiometric combustion mode, the homogeneous lean combustion mode, and the stratified lean combustion mode, in accordance with the air/fuel ratio control. For example, under a stable condition, the homogeneous lean combustion is operated at air/fuel ratio ranging from about 20 to 30, and the stratified lean combustion is operated at air/fuel ratio of about 40.

The region of combustion mode is defined basically based on a target equilibrium engine torque and an engine rotation.

Returning to FIG. 1, an exhaust gas from the combustion chamber 11 is discharged into an exhaust passage 24. The exhaust passage 24 has a catalytic converter 25 for purifying the exhaust gas.

The control unit 50, or controller, includes a microcomputer comprised of a CPU, a ROM, a RAM, an A/D converter and an input/output interface. The sections described herein are implemented in hardware, software, or a combination of both, in the control unit.

The control unit 50 receives signals from various sensors. These sensors include an accelerator sensor 26 for detecting an accelerator pedal position APS of an accelerator pedal 27; a coolant temperature sensor 28 for detecting the temperature Tw of the coolant of the engine; an $O_2$ sensor 29 positioned in the exhaust passage 24 for producing a signal corresponding to the rich/lean composition of the exhaust gas for actual air/fuel ratio determination; and vehicle speed sensor 30 for detecting the vehicle speed VSP.

The sensors also include an air flow meter 31 provided in the intake passage 17 at a position upstream of the throttle valve 20 for detecting an intake air rate Qa; a throttle sensor 32, including an idle switch positioned to be turned on when the throttle valve 20 is fully closed, for detecting a throttle opening degree TVO of throttle valve 20; and angle sensors 33 and 34 (engine rotation sensor) for detecting a rotation of a crankshaft or camshaft of the engine 10.

The sensors 33 and 34 produce a reference pulse signal REF and a unit pulse signal POS. The REF is outputted at every 720°/n of rotation of the crankshaft (where n is the number of cylinders). For example, in a four-cylinder engine, the REF is output at every 180° of rotation of the crankshaft. The POS is outputted at every 1 degree of rotation of the crankshaft. The control unit 50 calculates an engine rotation Ne based on the signal outputted from the sensors 33 and 34.

The control unit 50 receives the signals fed thereto from the various sensors and includes a microcomputer built therein for making the calculations described herein to control the opening degree of the electronic controlled throttle valve 20, the amount and timing of fuel injected to the engine by fuel injector 22, and spark timing of the spark plug 23.

Fuel amount control and throttle valve control will be described with reference to the block diagrams and the flow diagrams.

First Embodiment

Figure 2:
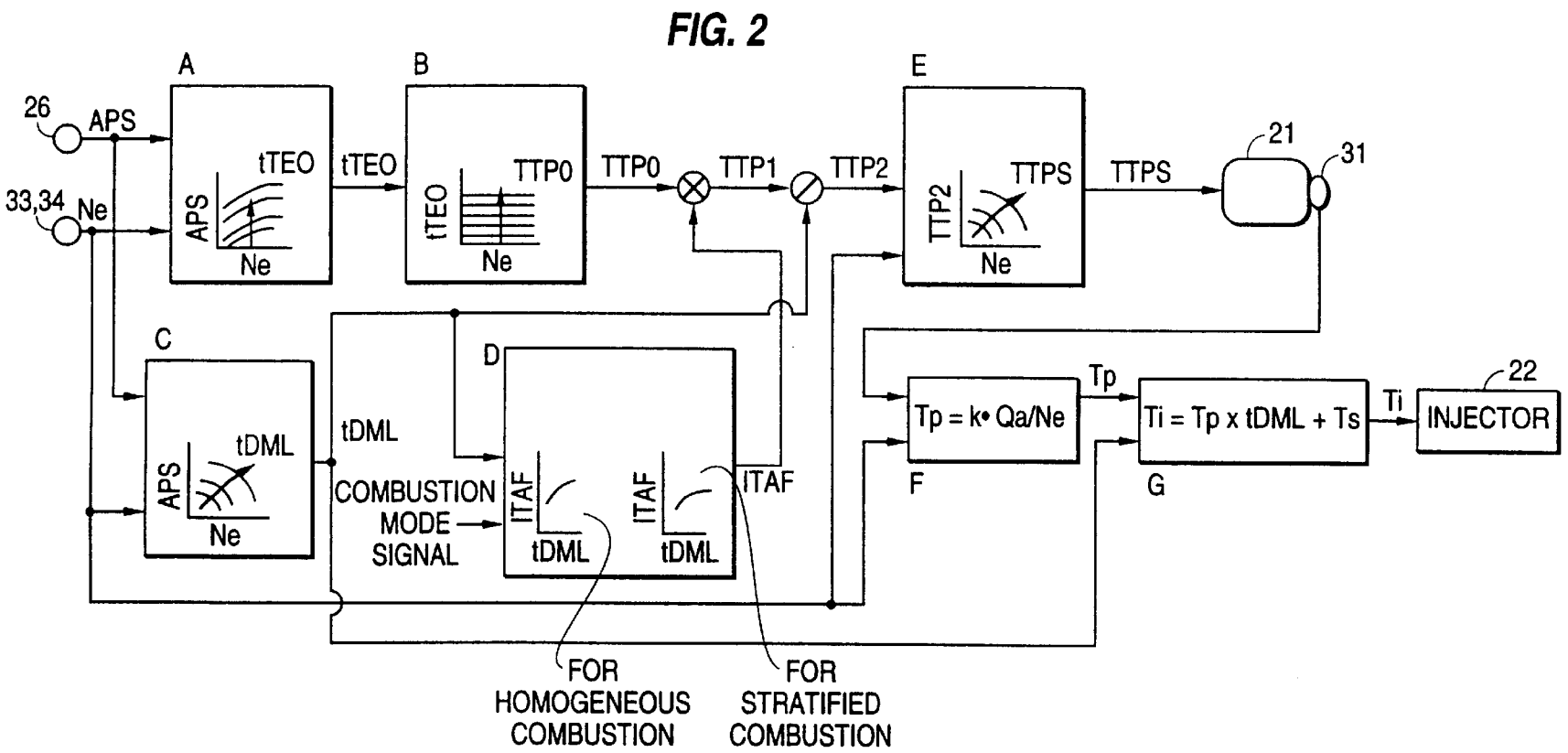
FIG. 2 is a block diagram used in a first embodiment.

The first embodiment will be described with reference to the block diagram of FIG. 2 and the flow diagram of FIG. 3. FIG. 2 shows the calculation of a target throttle position and a fuel injection pulse.

An equilibrium engine torque tTEO is calculated from a lookup table, as shown in a block A of FIG. 2. The lookup table, which may be obtained experimentally (e.g., from tests performed by the manufacturer), specifies the equilibrium engine torque tTEO (target engine torque) as a function of accelerator pedal position APS and engine rotation Ne. Here, the accelerator pedal position APS corresponds to the operator's demanded engine load or torque.

A target intake air flow rate TTPO, which corresponds to a ratio of reference air/fuel ratio (stoichiometric air/fuel ratio), is calculated from a lookup table, as shown in a block B of FIG. 2. The lookup table, which may be obtained experimentally (e.g., from tests performed by the manufacturer), specifies the target intake air flow rate TTPO as a function of engine rotation Ne and equilibrium engine torque tTEO calculated in the block A. An intake air quantity introduced into the engine during each intake stroke can be used instead of the target intake air flow rate TTPO. Also a basic fuel injection pulse width corresponding to the intake air quantity introduced into the engine during each intake stroke or the intake air quantity detected by air flow meter 31 every unit time can be used instead of the target intake air flow rate TTPO.

A target equivalent ratio tDML, which corresponds to the ratio of the reference air/fuel ratio (stoichiometric) with respect to the target ratio of air and fuel, is calculated from a lookup table, as shown in a block C of FIG. 2. The lookup table, which may be obtained experimentally (e.g., from tests performed by the manufacturer), defines the target equivalent ratio tDML as a function of accelerator pedal position APS and engine rotation Ne.

As discussed previously, the combustion modes include the homogeneous stoichiometric combustion mode, the homogeneous lean combustion mode, and the stratified lean combustion mode. Therefore, it is determined in the block C which combustion mode is operated, and the target equivalent ratio tDML is set within the predetermined range of determined combustion mode.

The target equivalent ratio tDML may be corrected by using one of the following factors or by combining more than one of the following factors; the coolant temperature Tw; the vehicle speed VSP; the acceleration of the vehicle; the elapsed time after the engine starting; the negative pressure of a brake booster; and the load of an auxiliary machine (such as an alternator during idling condition).

Also, as discussed previously, with the direct-injection engine, the produced engine torque is different between the homogeneous combustion and the stratified combustion, even if the air/fuel ratio is the same.

Here, the homogeneous combustion and the stratified combustion can be operated at the same air/fuel ratio when the combustion mode changes. As shown in FIG. 10, the combustion mode changes based on a target equilibrium engine torque and an engine rotation. For one example, when the target equilibrium engine torque changes into the direction of the arrow in FIG. 10, the combustion mode changes from the stratified lean combustion to the homogeneous lean combustion. At this time, as shown in FIGS. 11A–D, the purpose for reducing torque difference between the stratified lean combustion and the homogeneous lean combustion, the throttle valve is controlled to the shutting direction, and the equivalent ratio continuously increases corresponding to the decreasing of the intake air quantity. In this process, when the equivalent ratio crosses a rich limit of the stratified combustion (a lean limit of the homogeneous combustion), the stratified lean combustion and the homogeneous lean combustion can be operated at the same air/fuel ratio.

A combustion efficiency correction rate ITAF corresponding to each combustion is calculated from lookup tables, as shown in a block D of FIG. 2. These lookup tables, which may be obtained experimentally (e.g., from computer-simulated data or from actual tests performed on vehicles), define the combustion efficiency correction rate ITAF as a function of target equivalent ratio tDML.

A combustion mode signal, which shows whether the combustion mode (combustion state) is in the stratified combustion or in the homogeneous combustion, is inputted to the block D. In this embodiment, the combustion mode signal is generated in the block C. The target equivalent ratio tDML is also inputted to the block D.

When it is determined that the combustion mode is in the stratified combustion, the combustion efficiency correction rate ITAF is calculated from the lookup table provided for the stratified combustion with the target equivalent ratio tDML used in table lookup. When it is determined that the combustion mode is in the homogeneous combustion, the combustion efficiency correction rate ITAF is calculated from the lookup table provided for the homogeneous combustion with the target equivalent ratio tDML used in the table lookup.

The control unit 50 calculates a target intake air flow rate TTP1 by multiplying the target intake air flow rate TTPO calculated in block B with the combustion efficiency correction rate ITAF calculated in block D. Following the calculation of the target intake air flow rate TTP1, the control unit 50 calculates an eventual target intake air flow rate TTP2 by dividing the calculated target intake air flow rate TTP1 by the target equivalent ratio tDML calculated in block C. The eventual target intake air flow rate TTP2 corresponds to the target engine torque at the target air/fuel ratio and at the operated combustion state.

In this embodiment, as shown in FIG. 12, the combustion efficiency correction rate ITAF is defined as a fuel economy rate at the reference air/fuel ratio (stoichiometric) divided by a fuel economy rate for each air/fuel ratio. For example, the combustion efficiency correction rate ITAF for the homogeneous combustion mode at the point B is defined as b/a, and the combustion efficiency correction rate ITAF for the stratified combustion mode at the point E is defined as e/a. Therefore, the combustion efficiency correction rate ITAF is equal to 1 at the reference air/fuel ratio (14.6), and the combustion efficiency correction rate ITAF is less than 1 when the air/fuel ratio is lean as compared to the reference air/fuel ratio.

Figure 13:
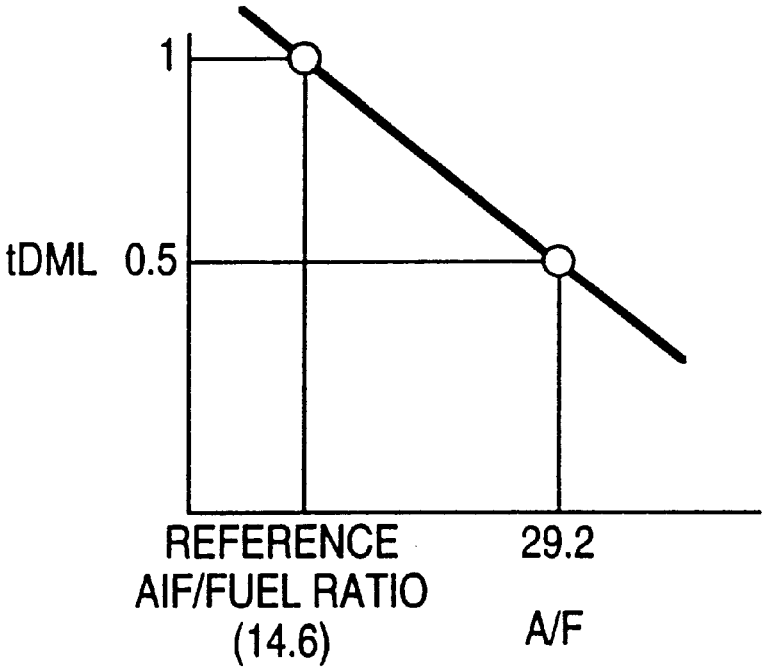
FIG. 13 is a diagram illustrating a target equivalent ratio corresponds to an air/fuel ratio.

On the other hand, as shown in FIG. 13, the target equivalent ratio tDML is defined as the reference air/fuel ratio (stoichiometric) divided by each air/fuel ratio. For example, the target equivalent ratio tDML is equal to 1 when the target air/fuel ratio is stoichiometric, and the target equivalent ratio tDML is equal to 0.5 when the target air/fuel ratio is 29.2.

Returning to FIG. 2, in this embodiment, although the target intake air flow rate TTPO is corrected by the target equivalent ratio tDML after correction by the combustion efficiency correction rate ITAF, alternatively, it may be also possible that the target intake air flow rate TTPO is corrected by the combustion efficiency correction rate ITAF after correction by the target equivalent ratio tDML.

A target throttle valve position TTPS is calculated from a lookup table, as shown in a block E of FIG. 2. The lookup table, which may be obtained experimentally (e.g., from tests performed by the manufacturer), defines the target throttle valve position TTPS as a function of eventual target intake air flow rate TTP2 and engine rotation Ne. The calculated target throttle valve position TTPS is transferred to the actuator 21, which thereby moves the throttle valve 20 to the target throttle valve position TTPS so as to achieve the eventual target intake air flow rate TTP2.

A basic fuel injection pulse width Tp (in units of msec) is calculated in the block F of FIG. 2. The basic fuel injection pulse width Tp is calculated as $Tp=k\cdot Qa/Ne$, where k is a constant, Qa is the intake air rate, and Ne is the engine rotation (in units of revolutions/second).

Following this calculation of the basic fuel injection pulse width Tp, an eventual fuel injection pulse width Ti (in units of msec) is calculated, as shown in the block G of FIG. 2. The eventual fuel injection pulse width Ti is calculated as $Ti=Tp\cdot tDML+Ts$, where Ts is the effective fuel injection pulse width (in units of msec). The calculated eventual fuel injection pulse width Ti is transferred to the fuel injector 22 so as to inject fuel in such an amount as to achieve the target air/fuel ratio.

FIG. 3 is a flow diagram, which shows the process for controlling the block diagram of FIG. 2.

First, in a step S1, which corresponds to the block A of FIG. 2, the equilibrium engine torque tTEO is calculated based on the accelerator pedal position APS and the engine rotation Ne.

In a step S2, which corresponds to the block C of FIG. 2, the target equivalent ratio tDML is calculated based on the accelerator pedal position APS and the engine rotation Ne.

In a step S3, which corresponds to the block B of FIG. 2, the target intake air flow rate TTPO is calculated based on the equilibrium engine torque tTEO calculated in the step S1 and the engine rotation Ne.

In a step S4, it is determined whether the combustion mode (combustion state) is in the stratified combustion or in the homogeneous combustion. When the combustion mode is in the stratified combustion, the routine proceeds to a step S5, and the combustion efficiency correction rate ITAF for the stratified combustion is calculated based on the target equivalent ratio tDML. On the other hand, when the combustion mode is in the homogeneous combustion, the routine proceeds to a step S6, and the combustion efficiency correction rate ITAF for the homogeneous combustion is calculated based on the target equivalent ratio tDML. These step S4 through S6 correspond to the block D of FIG. 2.

In a step S7, the target intake air flow rate TTP1 is calculated by the following equation (1), where TTPO is the target intake air flow rate calculated in the step S3, and ITAF is the combustion efficiency correction rate calculated in the step S5 or S6.

$$TTP1=TTPO\cdot ITAF \quad (1)$$

Like this, since the target intake air flow rate TTP1 is corrected by the combustion efficiency correction rate ITAF, the target engine torque can be achieved accurately without being affected by the difference of combustion state. Also, a torque difference does not occur even though the combustion mode changes between the homogeneous combustion and the stratified combustion.

In a step S8, the eventual target intake air flow rate TTP2, which corresponds to the target equivalent ratio tDML, is calculated by the following equation (2), where TTP1 is the target intake air flow, rate calculated in the step S7, and tDML is the target equivalent ratio calculated in the step S2.

$$TTP2=TTP1/tDML \quad (2)$$

In a step S9, which corresponds to the block E of FIG. 2, the target throttle valve position TTPS is calculated based on the eventual target intake air flow rate TTP2 and engine rotation Ne. The calculated target throttle valve position TTPS is outputted to the actuator 21 of the throttle valve 20, so as to achieve the eventual target intake air flow rate TTP2.

In a step S10, which corresponds to the block F of FIG. 2, the basic fuel injection pulse width Tp is calculated as $Tp=k\cdot Qa/Ne$, where k is a constant, Qa is the intake air rate, and Ne is the engine rotation.

In a step S11, which corresponds to the block G of FIG. 2, the eventual fuel injection pulse width Ti is calculated as $Ti=Tp\cdot tDML+Ts$, where tDML is the target equivalent ratio calculated in the step S2, Tp is the basic fuel injection pulse width calculated in the step S10, and Ts is the effective fuel injection pulse width.

In a step S12, the calculated eventual fuel injection pulse width Ti is outputted to the injector 22 according to the predetermined timing which corresponds to the homogeneous combustion or the stratified combustion.

Second Embodiment

Figure 4:
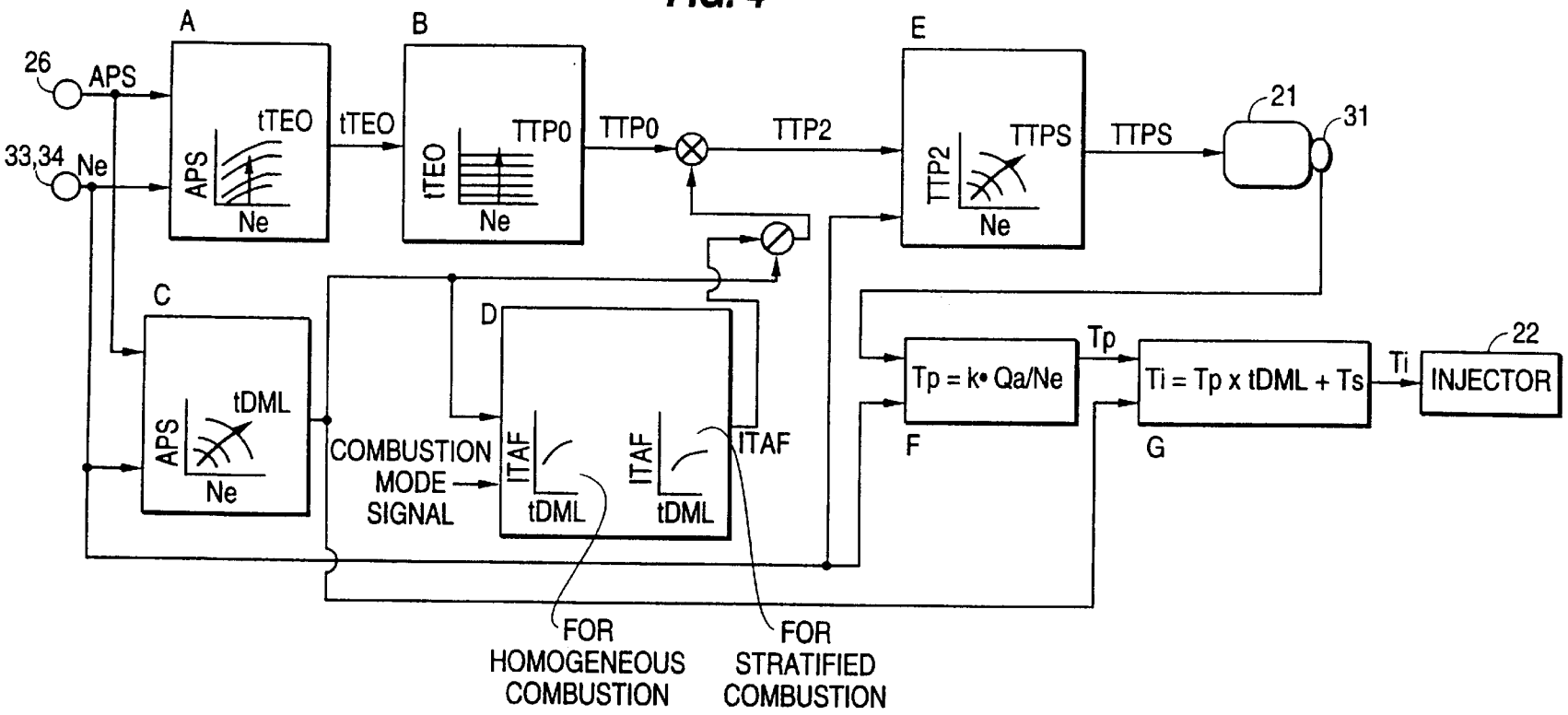
FIG. 4 is a block diagram used in a second embodiment.

In the second embodiment, the target throttle valve position is calculated as shown in FIG. 4. The basic composition is similar to that as shown in FIG. 1.

Referring to FIG. 4, the correction to the target intake air flow rate TTPO with the target equivalent ratio tDML and the combustion efficiency correction rate ITAF is different from the block diagram of FIG. 2. The other blocks are the same as the FIG. 2. Therefore, the other blocks are given the same reference characters as in FIG. 2, and the explanation is not repeated for sake of brevity and clarity.

As shown in a block C and D of FIG. 4, the control unit 50 calculates the target equivalent ratio tDML and the combustion efficiency correction rate ITAF. Following this calculation, a correction value to the target intake air flow rate TTPO is calculated by dividing the target equivalent ratio tDML by the combustion efficiency correction rate ITAF. Next the eventual target intake air flow rate TTP2 is calculated by multiplying the target intake air flow rate TTPO with the calculated collection value.

Summarizing this second embodiment, a correction with the target equivalent ratio tDML and the correction with the combustion efficiency correction rate ITAF are done to the target intake air flow rate TTPO at the same time.

Third Embodiment

The third embodiment will be described with reference to the block diagram of FIG. 5 and the flow diagram of FIG. 6. The basic composition is similar to that as shown in FIG. 1.

Figure 5:
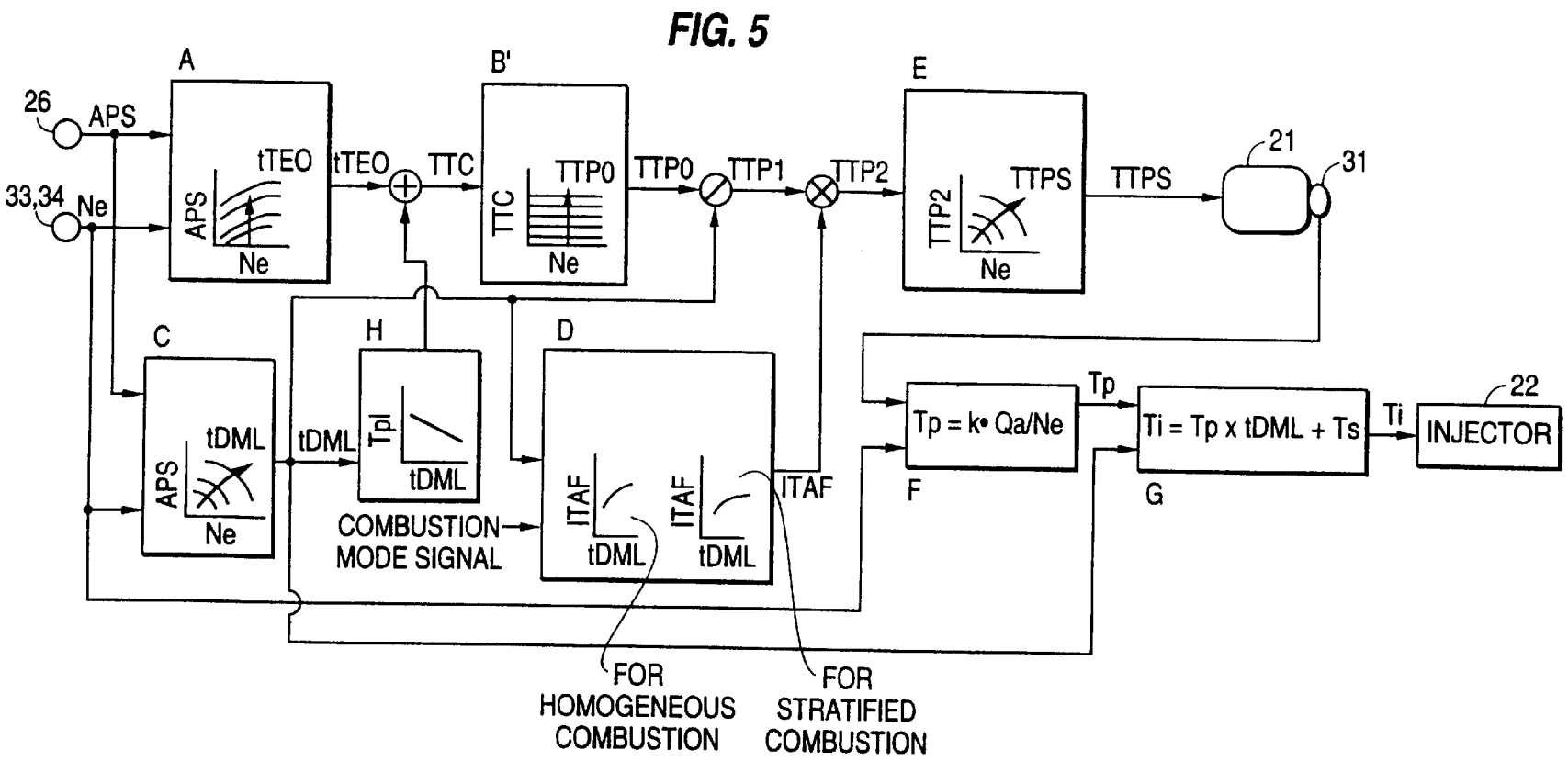
FIG. 5 is a block diagram used in a third embodiment.

FIG. 5 shows the calculation of a target throttle valve position and a fuel injection pulse. The block H is added to the block diagram of FIG. 2, and the correction order to the target intake air flow rate TTPO with the target equivalent ratio tDML and the combustion efficiency correction rate ITAF is different from the block diagram of FIG. 2.

Blocks the same as first embodiment are given the same reference characters as in FIG. 2, and the explanation is not repeated for sake of brevity and clarity.

A pumping loss torque TpI, which corresponds to the target equivalent ratio, is calculated from a lookup table, as shown in the block H of FIG. 5. The lookup table, which may be obtained experimentally (e.g., from tests performed by the manufacturer), defines the pumping loss torque TpI as a function of target equivalent ratio tDML.

Figure 14:
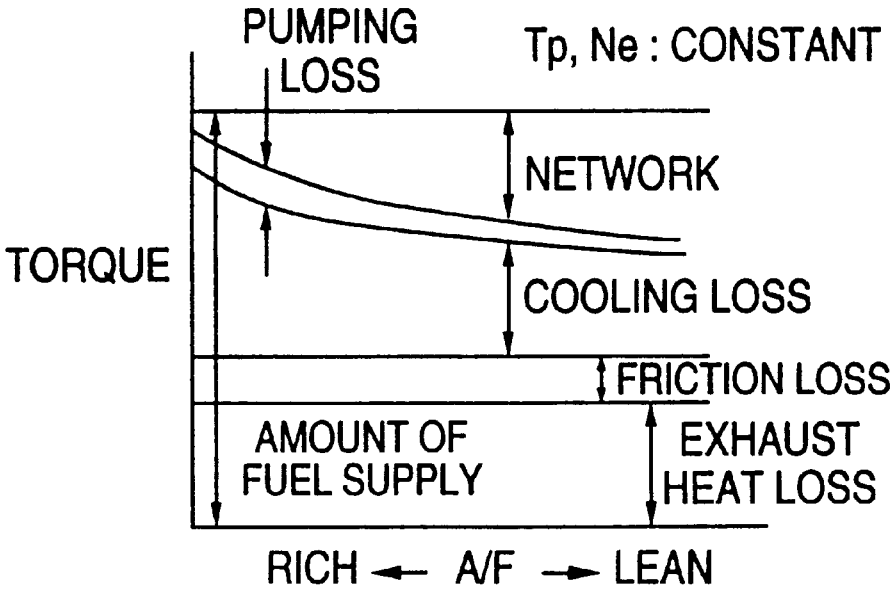
FIG. 14 is a diagram illustrating various loss of an engine under a constant condition of an engine rotation and a fuel supply.

The reason the pumping loss torque TpI is defined as a function of target equivalent ratio tDML is, as shown in FIG. 14, the pumping loss torque TpI becomes small by shifting the air/fuel ratio to lean. As the lean combustion involves a larger quantity of intake air under the same operating condition, the throttle valve can be opened to reduce the pumping loss. Therefore, the control unit 50 calculates a equilibrium engine torque TTC by adding the pumping loss torque TpI to the equilibrium engine torque tTEO calculated in the block A.

The target intake air flow rate TTPO, which corresponds to a ratio of reference air/fuel ratio (stoichiometric), is calculated from a lookup table, as shown in a block B' of FIG. 5. The lookup table, which may be obtained experimentally (e.g., from tests performed by the manufacturer), specify the target intake air flow rate TTPO as a function of engine rotation Ne and equilibrium engine torque TTC corrected by the pumping loss torque TpI.

The control unit 50 calculates a target intake air flow rate TTP1 by dividing the target intake air flow rate TTPO by the target equivalent ratio tDML calculated in block C. Following the calculation of the target intake air flow rate TTP1, the control unit 50 calculates an eventual target intake air flow rate TTP2 by multiplying the target intake air flow rate TTP1 with the combustion efficiency correction rate ITAF calculated in block D. Next, based on the calculated eventual target intake air flow rate TTP2, the target throttle valve position TTPS is calculated in block E.

With this third embodiment, since the equilibrium engine torque tTEO is corrected by the pumping loss torque TpI, which is calculated in accordance with the changing of air/fuel ratio, the demanded torque by the operator is obtained accurately and is not influenced by the difference of target equivalent ratio tDML.

Figure 6:
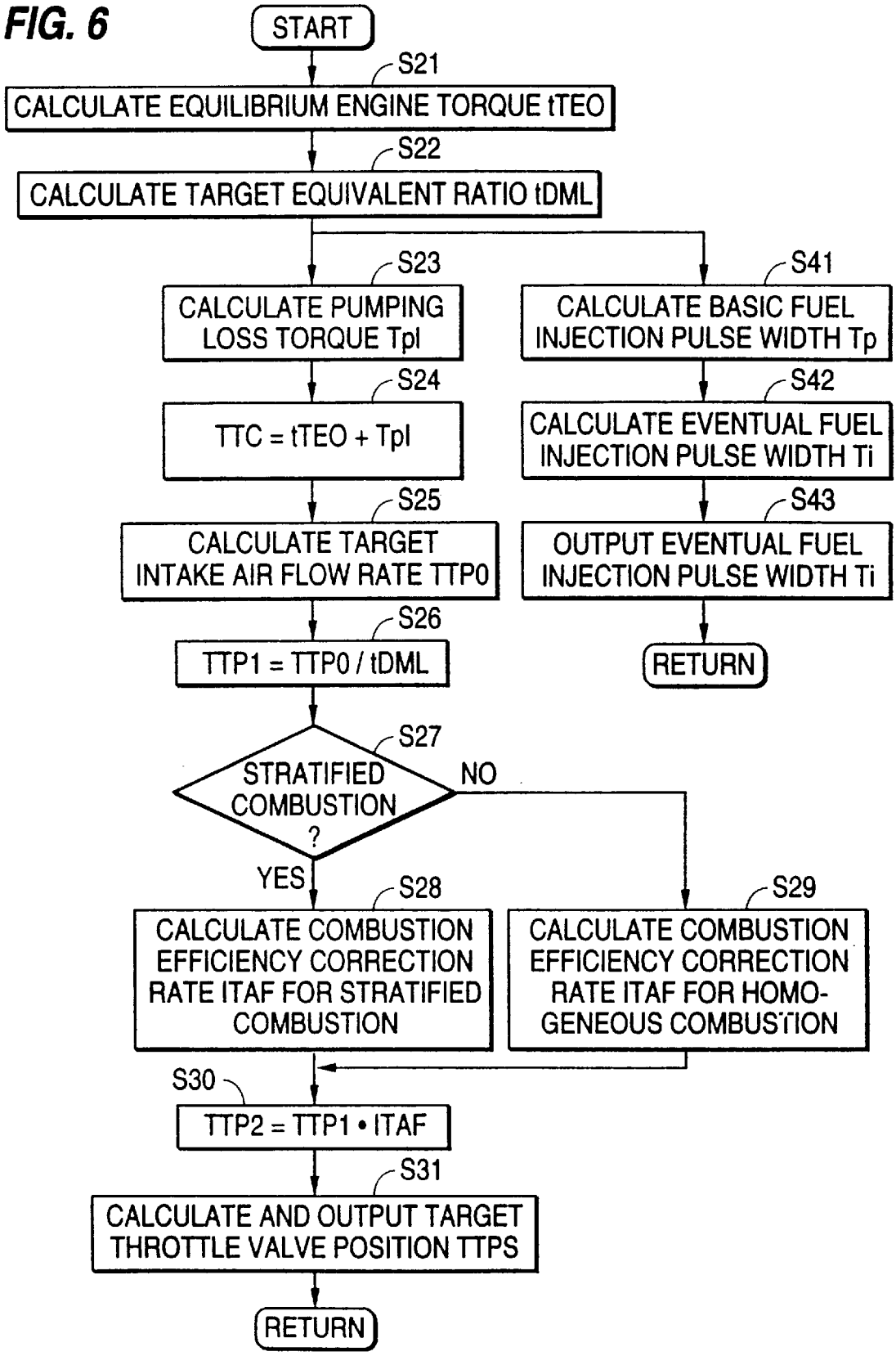
FIG. 6 is a flow diagram used in a third embodiment.

FIG. 6 is a flow diagram, which shows the process for controlling the block diagram of FIG. 5.

In a step S21, which corresponds to the block A of FIG. 5, the equilibrium engine torque tTEO is calculated based on the accelerator pedal position APS and the engine rotation Ne.

In a step S22, which corresponds to the block C of FIG. 5, the target equivalent ratio tDML is calculated based on the accelerator pedal position APS and the engine rotation Ne.

In a step S23, which corresponds to the block H of FIG. 5, the pumping loss torque TpI is calculated based on the target equivalent ratio tDML.

In a step S24, the equilibrium engine torque TTC is calculated by the following equation (3), where tTEO is the equilibrium engine torque calculated in the step S21, and TpI is the pumping loss torque calculated in the step S23.

$$TTC=tTEO+TpI \tag{3}$$

In a step S25, which corresponds to the block B' of FIG. 5, the target intake air flow rate TTPO is calculated based on the equilibrium engine torque TTC calculated in the step S24 and the engine rotation Ne.

In a step S26, the eventual target intake air flow rate TTP1, which corresponds to the target equivalent ratio, is calculated by the following equation (4), where TTPO is the target intake air flow rate calculated in the step S25, and tDML is the target equivalent ratio calculated in the step S22.

$$TTP1=TTPO/tDML \tag{4}$$

In a step S27, it is determined whether the combustion mode (combustion state) is in the stratified combustion or in the homogeneous combustion. When the combustion mode is in the stratified combustion, the routine proceeds to a step S28, and the combustion efficiency correction rate ITAF for the stratified combustion is calculated based on the target equivalent ratio tDML. On the other hand, when the combustion mode is in the homogeneous combustion, the routine proceeds to a step S29, and the combustion efficiency correction rate ITAF for the homogeneous combustion is calculated based on the target equivalent ratio tDML. These step S27 through S29 correspond to the block D of FIG. 5.

In a step S30, the target intake air flow rate TTP2 is calculated by the following equation (5), where TTP1 is the target intake air flow rate calculated in the step S26, and ITAF is the combustion efficiency correction rate calculated in the step S28 or S29.

$$TTP2=TTP1\cdot ITAF \tag{5}$$

In a step S31, which corresponds to the block E of FIG. 5, the target throttle valve position TTPS is calculated based on the eventual target intake air flow rate TTP2 and the engine rotation Ne. The calculated target throttle valve position TTPS is outputted to the actuator 21 of the throttle valve 20, so as to achieve the eventual target intake air flow rate TTP2.

In a step S41, which occurs after the step S22 and which corresponds to the block F of FIG. 5, the basic fuel injection pulse width Tp is calculated as $Tp=k\cdot Qa/Ne$, where k is a constant, Qa is the intake air rate, and Ne is the engine rotation.

In a step S42, which corresponds to the block G of FIG. 5, the eventual fuel injection pulse width Ti is calculated as $Ti=Tp\cdot tDML+Ts$, where tDML is the target equivalent ratio calculated in the step S22, Tp is the basic fuel injection pulse width calculated in the step S41, and Ts is the effective fuel injection pulse width.

In a step S43, the calculated eventual fuel injection pulse width Ti is outputted to the injector 22 according to the predetermined timing which corresponds to the homogeneous combustion or the stratified combustion.

Fourth Embodiment

The fourth embodiment will be described with reference to the block diagram of FIG. 7 and the flow diagram of FIG. 8. The basic composition is similar to that as shown in FIG. 1.

Figure 7:
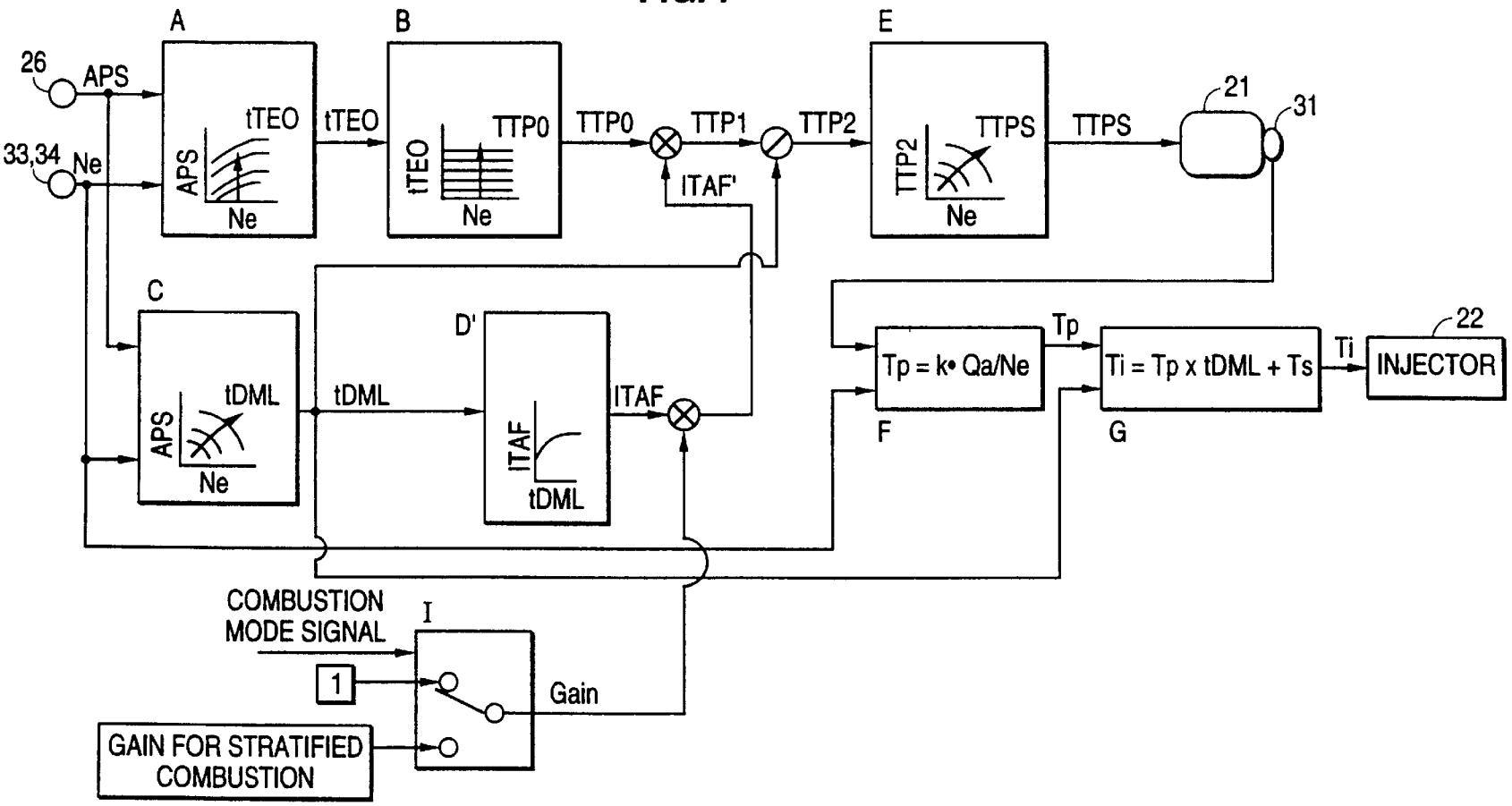
FIG. 7 is a block diagram used in a fourth embodiment.

FIG. 7 shows the calculation of a target throttle valve position and a fuel injection pulse. A block I is added to the block diagram of FIG. 2, and a block D' is modified from the block D of FIG. 2. The other blocks are the same as the block diagram of FIG. 2. Therefore, those other blocks are given the same reference characters as in FIG. 2, and the explanation of those blocks is not repeated for sake of brevity and clarity.

The combustion efficiency correction rate ITAF is calculated from a lookup table, as shown in a block D' of FIG. 7. The lookup table, which may be obtained experimentally (e.g., from computer-simulated data or from a fuel tests performed on vehicles), defines the combustion efficiency correction rate ITAF as a function of target equivalent ratio tDML. Comparing with the block D of FIG. 2, since there is only one lookup table, the data storage capacity of the control unit 50 is reduced.

A combustion mode signal, which shows whether the combustion mode (combustion state) is in the stratified combustion or in the homogeneous combustion, is inputted to the block I of FIG. 7. The block I switches a gain based on the combustion mode signal.

The block I outputs a Gain, which corrects the combustion efficiency correction rate ITAF so as to be suited for the stratified combustion when the combustion mode is in the stratified combustion. When the combustion mode is in the homogeneous combustion, the block I outputs 1 as the Gain.

The combustion efficiency correction rate ITAF is corrected by multiplying it with the Gain. With this result, when the combustion mode is in the stratified combustion, the combustion efficiency correction rate ITAF calculated in the block D' of FIG. 7 is converted to a suitable value for the stratified combustion. When the combustion mode is in the homogeneous combustion, the combustion efficiency correction rate ITAF calculated in the block D' of FIG. 7 is outputted as it is.

Figure 9:
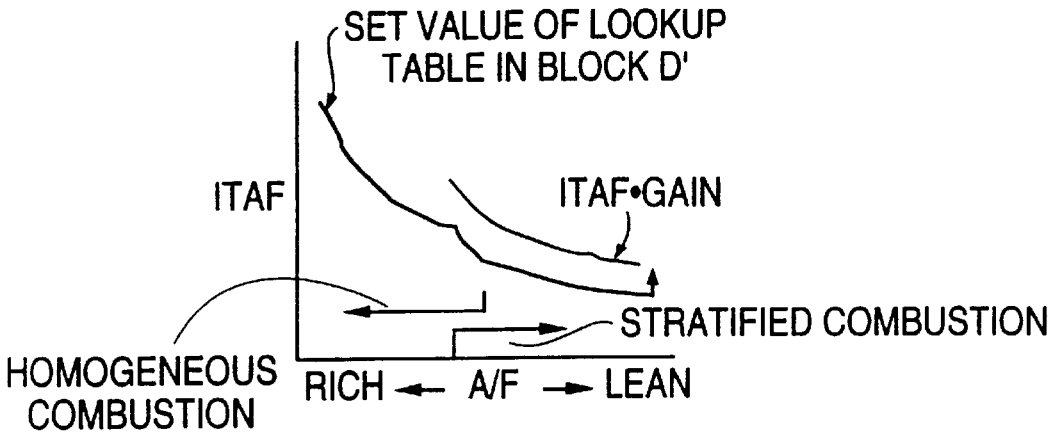
FIG. 9 is a lookup table illustrating a combustion efficiency correction rate used in a fourth embodiment.

As shown in FIG. 9, the lookup table in the block D' defines the combustion efficiency correction rate ITAF as a function of target equivalent ratio tDML (target air/fuel ratio) in entire range of the engine. Moreover, in the region where the combustion mode changes, the combustion efficiency correction rate ITAF is suited for homogeneous combustion. Therefore, the combustion efficiency correction rate ITAF is corrected by multiplying by the Gain (>1) when the combustion mode is in the stratified combustion.

In the present invention the Gain can be a fixed value or it can be a changeable value. However, a fixed value is preferable to reduce the capacity of the memory.

FIG. 8 is a flow diagram, which shows the process for controlling the block diagram of FIG. 7.

In a step S51, which corresponds to the block A of FIG. 7, the equilibrium engine torque tTEO is calculated based on the accelerator pedal position APS and the engine rotation Ne.

In a step S52, which corresponds to the block C of FIG. 7, the target equivalent ratio tDML is calculated based on the accelerator pedal position APS and the engine rotation Ne.

In a step S53, which corresponds to the block B of FIG. 7, the target intake air flow rate TTPO is calculated based on the equilibrium engine torque tTEO calculated in the step S51 and the engine rotation Ne.

In a step S54, which corresponds to the block D' of FIG. 7, the combustion efficiency correction rate ITAF is calculated based on the target equivalent ratio tDML calculated in the step S52.

In a step S55, it is determined whether the combustion mode (combustion state) is in the stratified combustion or in the homogeneous combustion based on the combustion mode signal. When the combustion mode is in the stratified combustion, the routine proceeds to a step S56, and the Gain (>1) for the stratified combustion is selected On the other hand, when the combustion mode is in the homogeneous combustion, the routine proceeds to a step S57, and the Gain (=1) for the homogeneous combustion is selected. These step S55 through S57 correspond to the block I of FIG. 7.

In a step S58, the combustion efficiency correction rate ITAF' is calculated by the following equation (6), where ITAF is the combustion efficiency correction rate calculated in the step S54, and Gain is the gain selected in the step S56 or S57.

$$ITAF'=ITAF\cdot Gain \tag{6}$$

In a step S59, the target intake air flow rate TTP1 is calculated by the following equation (7), where TTPO is the target intake air flow rate calculated in the step S53, and ITAF' is the combustion efficiency correction rate calculated in the step S58.

$$TTP1=TTPO\cdot ITAF' \tag{7}$$

In a step S60, the eventual target intake air flow rate TTP2, which corresponds to the target equivalent ratio tDML, is calculated by the following equation (8), where TTP1 is the target intake air flow rate calculated in the step S59, and tDML is the target equivalent ratio calculated in the step S52.

$$TTP2=TTP1/tDML \tag{8}$$

In a step S61, which corresponds to the block E of FIG. 7, the target throttle valve position TTPS is calculated based on the eventual target intake air flow rate TTP2 and the engine rotation Ne. The calculated target throttle valve position TTPS is outputted to the actuator 21 of the throttle valve 20, so as to achieve the eventual target intake air flow rate TTP2.

In a step S62, which corresponds to the block F of FIG. 7, the basic fuel injection pulse width Tp is calculated as $Tp=k\cdot Qa/Ne$, where k is a constant, Qa is the intake air rate, and Ne is the engine rotation.

In a step S63, which corresponds to the block G of FIG. 7, the eventual fuel injection pulse width Ti is calculated as $Ti=Tp\cdot tDML+Ts$, where tDML is the target equivalent ratio calculated in the step S52, Tp is the basic fuel injection pulse width calculated in the step S62, and Ts is the effective fuel injection pulse width.

In a step S64, the calculated eventual fuel injection pulse width Ti is outputted to the injector 22 according to the predetermined timing which corresponds to the homogeneous combustion or the stratified combustion.

The foregoing invention has been described in terms of preferred embodiments. However, those skilled in the art will recognize that many variations of such embodiments exists. Such variations are intended to be within the spirit and scope of the present invention and the appended claims.

What is claimed is:

1. A method for controlling an intake air quantity of an internal combustion engine, comprising:

detecting an engine operating condition including whether an engine combustion mode is in a homogeneous combustion mode or a stratified combustion mode;

calculating a target intake air quantity and a target ratio of air and fuel based on the engine operating condition; and correcting the target intake air quantity based on the engine combustion mode and the target ratio of air and fuel.

2. A torque controller which controls an intake air quantity of an internal combustion engine, comprising:

a detector to detect an engine operating condition including whether an engine combustion mode is in a homogeneous combustion mode or a stratified combustion mode;

a target intake air quantity calculation section to calculate a target intake air quantity based on the engine operating condition;

a target ratio of air and fuel calculation section to calculate a target ratio of air and fuel based on the engine operating condition; and a correction section to correct the target intake air quantity based on the engine combustion mode and the target ratio of air and fuel.

3. A torque controller which controls an intake air quantity of an internal combustion engine, comprising:

a detector to detect an engine operating condition including whether an engine combustion mode is in a homogeneous combustion mode or a stratified combustion mode;

a target intake air quantity calculation section to calculate a target intake air quantity based on the engine operating condition;

a target ratio of air and fuel calculation section to calculate a target ratio of air and fuel based on the engine operating condition;

a combustion efficiency correction rate calculation section to calculate a combustion efficiency correction rate based on the engine combustion mode and the target ratio of air and fuel; and a correction section to correct the target intake air quantity based on the combustion efficiency correction rate and the target ratio of air and fuel.

4. A torque controller as set forth in claim 3, wherein the detector further includes an engine rotation sensor to detect an engine rotation and an accelerator sensor to detect an accelerator pedal position, wherein the target intake air quantity calculation section calculates the target intake air quantity based on the engine rotation and the accelerator pedal position, and wherein the target ratio of air and fuel calculation section calculates the target ratio of air and fuel based on the engine rotation and the accelerator pedal position.

5. A torque controller as set forth in claim 3, wherein the correction section includes tables storing data which define the combustion efficiency correction rate respectively for the homogeneous combustion mode and the stratified combustion mode as a function of the target ratio of air and fuel.

6. A torque controller as set forth in claim 3, further comprising a gain switching section to switch a gain based on the engine combustion mode, wherein the correction section includes a table storing data which defines the combustion efficiency correction rate as a function of the target ratio of air and fuel, and wherein the combustion efficiency correction rate calculated from the table is corrected by the gain.

7. A torque controller as set forth in claim 6, wherein the table defines the combustion efficiency correction rate over an entire range of the target ratio of air and fuel of the engine.

8. A torque controller as set forth in claim 3, wherein the correction section corrects the target intake air quantity using the combustion efficiency correction rate and the target ratio of air and fuel in a particular order.

9. A torque controller as set forth in claim 3, further comprising a pumping loss torque calculation section to calculate a pumping loss torque of the engine, wherein the target intake air quantity calculation section calculates a target intake air quantity based on the engine operating condition and the pumping loss torque of the engine.

10. A torque controller as set forth in claim 9, wherein the pumping loss torque of the engine is calculated based on the target ratio of air and fuel.

11. A torque controller as set forth in claim 3, wherein the engine includes an injector which injects fuel directly into a combustion chamber of the engine, wherein the injector injects fuel during an intake stroke when the combustion mode is in the homogeneous combustion mode, and injects fuel during a compression stroke when the combustion mode is in the stratified combustion mode.

12. A torque controller which controls an intake air quantity of an internal combustion engine, comprising:

detect means for detecting an engine operating condition including whether an engine combustion mode is in a homogeneous combustion mode or a stratified combustion mode;

target intake air quantity calculation means for calculating a target intake air quantity based on the engine operating condition;

target ratio of air and fuel calculation means for calculating a target ratio of air and fuel based on the engine operating condition; and correction means for correcting the target intake air quantity based on the engine combustion mode and the target ratio of air and fuel.

* * * * *